United States Patent [19]

Rieger

[11] Patent Number: 4,909,227

[45] Date of Patent: Mar. 20, 1990

[54] DIRECT TOP VENTING HIGH EFFICIENCY FIREPLACE

[76] Inventor: Heinz H. Rieger, 17 Martin Road, Toronto, Ontario, Canada, M4S 2V1

[21] Appl. No.: 331,839

[22] Filed: Apr. 3, 1989

[51] Int. Cl.[4] ..... F24B 7/00

[52] U.S. Cl. ..... 126/531; 126/85 B; 126/521; 126/527

[58] Field of Search ..... 126/523, 531, 85 B, 126/77, 80, 83, 89, 529, 193, 533, 527, 518; 237/51, 55; 98/46, 48

[56] References Cited

U.S. PATENT DOCUMENTS 3,056,397 10/1962 Little ..... 126/85 B
4,141,336 2/1979 Fitch ..... 126/529
4,519,376 5/1985 Schoeff et al. ..... 126/531
4,553,528 11/1985 Wells ..... 126/531
4,793,322 12/1988 Shimek et al. ..... 126/85 B

*Primary Examiner*—James C. Yeung
*Attorney, Agent, or Firm*—David W. Wong

[57] ABSTRACT

The fireplace has a coaxial vent directly venting the exhaust gas through its top. The fresh air is directed through an outer jacket of the coaxial vent to a chamber located between the firebox and the rear panel and enters into the lower portion of the firebox while the exhaust air is conducted through the inner coaxial duct, located inside the fresh air duct, to be released to the outdoor. Residual heat in the exhaust gas is inherently recycled by the fresh air being drawn into the fireplace to enhance combustion and to increase the efficiency for heating purposes.

4 Claims, 2 Drawing Sheets

DIRECT TOP VENTING HIGH EFFICIENCY FIREPLACE

BACKGROUND OF THE INVENTION

This invention relates to a fireplace and particularly relates to a fireplace having a direct top venting for both directing exhaust gas outdoor as well as conducting frest air into the firebox for providing high efficiency combustion and heating purposes.

Heretofore, fireplaces have not been efficient for use for heating purposes. this is mainly due to that a large amount of the heat generated in the fireplace is invariably dissipated with the exhaust gas released through the chimney. Furthermore, the combustion efficiency of the gas in the fireplace particularly for a natural gas fireplace is low due to the lack of frest air. In order to supply fresh air to the fireplace a separate ducting apart from the exhaust chimney or ducting is required to direct the fresh air from the outdoor into the fireplace. Such separate ducting requires addition time and labour to install. Also, due to the high temperature of the exhaust gas, the exhaust ducting is commonly adapted at the top portion of the rear panel of the fireplace, necessitating the use of an extra elbow coupling to join with the vertical rise section of the exhaust ducting. Thus, extra space in the building structure is required to accommodate the elbow coupling, making it impossible to install the fireplace close to the wall located adjacent to its rear.

SUMMARY OF THE INVENTION

The primary object of the present invention is to provide a fireplace having a high operating efficiency for heating purposes.

It is another object of the present invention to provide a fireplace having a direct venting through its top.

It is another object of the present invention to provide a fireplace which has a single ducting system for both conducting fresh air into the firebox as well as directing exhaust gas to the outdoor from the firebox.

It is yet another object of the present invention to provide a fireplace which has a relatively cool rear panel such that it can be installed with its rear panel close to a building wall.

Still another object of the present invention is to provide a fireplace having a relatively cool ducting system.

The invention, its features and further objects thereof are further delineated in the detailed description to follow of an illustrative embodiment.

DETAILED DESCRIPTION OF THE PREFERRED EMBODIMENTS

Figure 3:
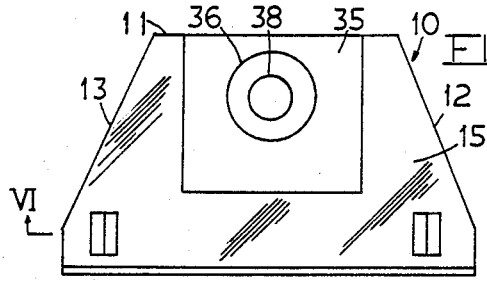
FIG. 3 is a top elevation view thereof.
Figure 1:
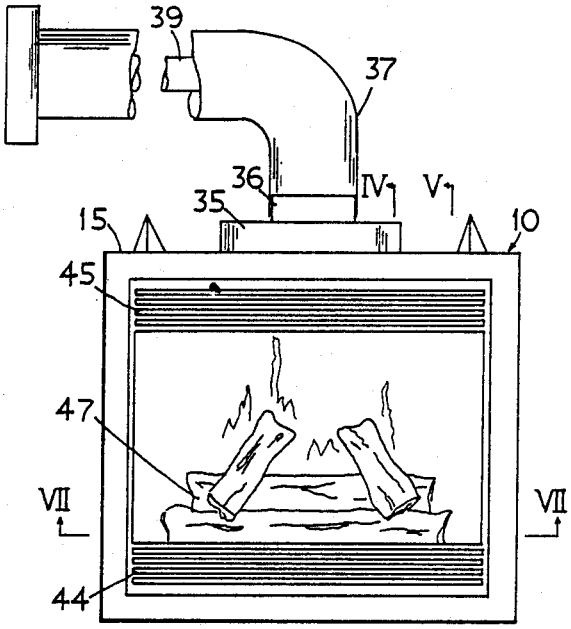
FIG. 1 is a front elevation view of the fireplace according to the present invention.
Figure 2:
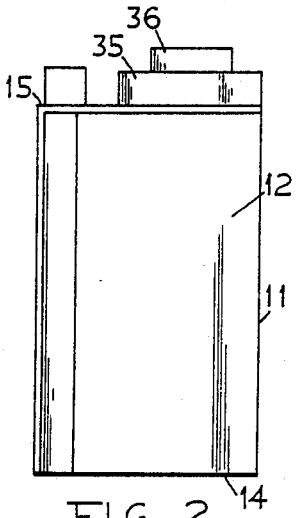
FIG. 2 is a right side elevation view thereof.
Figure 5:
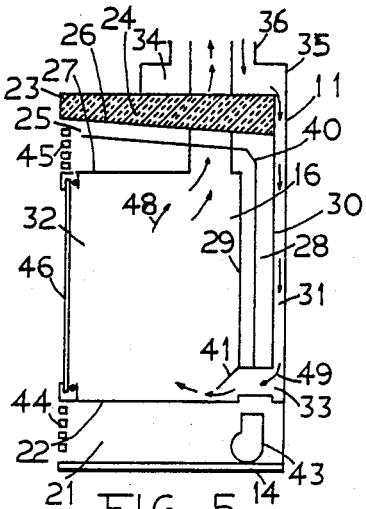
FIG. 5 is a cross section side view of the fireplace per se along section line V—V of FIG. 1.
Figure 4:
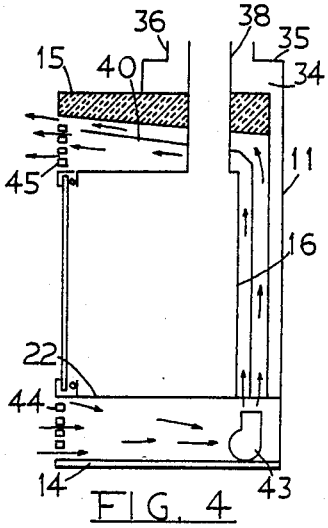
FIG. 4 is a cross section side view of the fire-place per se along section line IV—IV of FIG. 1.
Figure 6:
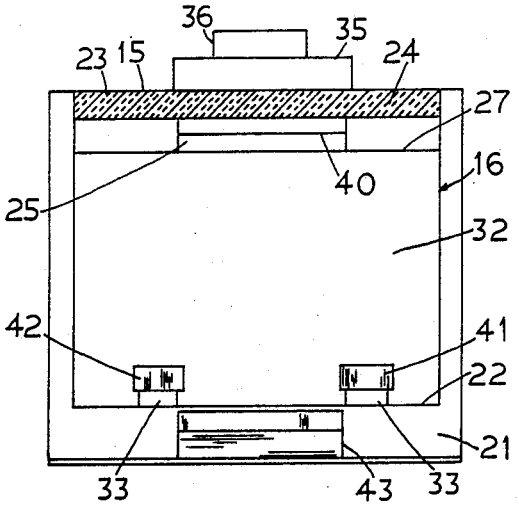
FIG. 6 is a cross section front view of the fire-place along section line VI—VI of FIG. 3.
Figure 7:
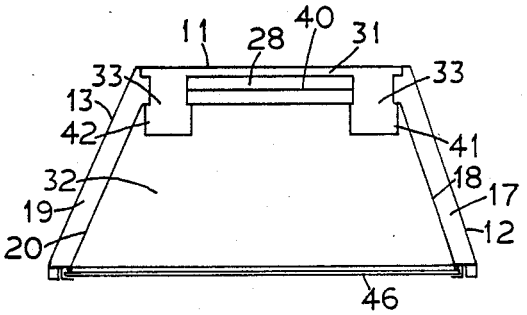
FIG. 7 is a cross section bottom view thereof along section line VII—VII of FIG. 1.

With reference to the drawings wherein like reference numerals designate corresponding parts in the several views, the fireplace according to the present invention is generally shown by the reference numeral 10. It has an outer rear panel 11, outer right side panel 12, outer left side panel 13, outer bottom panel 14, and outer top panel 15. The firebox 16 is provided in a spaced manner within the outer enclosure such that an air space 17 is formed between the right side wall 18 of the firebox 16 to the outer right side wall 12, an air space 19 is formed between the outer left side wall 13 and the left side wall 20 of the firebox, a bottom air space 21 is formed between the outer bottom panel 14 and the bottom panel 22 of the firebox. An insulation chamber 23 is provided under the outer top panel 15. The chamber 23 is filled with heat insulation material 24 such as fibreglass wool. A top air space 25 is formed between the bottom panel 26 of the insulation chamber 23 and the top panel 27 of the firebox 16. A rear air space 28 is provided between the rear panel 29 of the firebox 16 and an inner rear partition panel 30. A fresh air chamber 31 is formed between the outer rear panel 11 and the inner rear partition panel 30. The air spaces 17, 19, 21, 25, and 28 are in communication with one another. The fresh air chamber 31 is in communication with the inside cavity 32 of the firebox 16 through at least one and preferably two rectangular openings 33 formed at the bottom portion of the firebox 16. The fresh air chamber 31 is also in communication with the outer chamber 34 of a venting adaptor 35 provided at the outside of the top panel 15. The venting adaptor 35 has an upstanding sleeve 36 for mounting engagement with the vent duct 37. The top exhaust 38 of the firebox 16 extends in a coaxial manner upwards in the venting adaptor 35 for mounting engagement with the coaxial inner vent duct 39 of the vent duct 37. The coaxial vent ducts 37 and 39 are L-shaped overall and having a horizontal span considerably longer than their vertical portion designed to direct the exhaust gas from and fresh air to the firebox 16 in a horizontal direction from a vent cap provided on the vertical outside wall of the building in which the firebox is located as best shown in FIG. 1. The top air space 25 and rear air space 28 are separated into two halves by a heat shield panel 40 forming an inner air space adjacent the firebox 16 and an outer air space adjacent the insulation chamber 23 as well as the fresh air chamber 31. Two skewed canopies 41 and 42 are provided in a cantilever manner over the top edge of the openings 33. A blower 43 is provided in the bottom space 21 and operative to draw air through the decorative bottom front grill 44 to flow through the bottom space 21, rear air space 28, and top air space 25 to exit through the decorative front grill 45. The front of the firebox 16 may be closed with a heat tempered glass door 46.

In operation, when the log assembly 47 of the fireplace is lighted, the hot exhaust gas 48 emitted from burning rises up through the top exhaust 38 due to the convection effect and it travels through the inner vent duct 39 and through the horizontal portion of the vent duct system to exit to the outdoor through the vent cap provided on the vertical outside wall of the building. In the meantime, fresh air 49 from outdoor is drawn through the vent cap into the firebox cavity 32 through the outer vent duct 37, the outer chamber 34 of the venting adaptor 35, the rear fresh air chamber 31, and the rectangular openings 33, for enhancing the combustion. The residual heat in the exhaust gas 48 travelling through the inner vent duct 38 is transferred to the fresh air 49 travelling through the outer vent duct 37. Thus, the residual heat is returned to the fireplace cavity 32 to increase the heating efficiency of the fireplace. Also, the heated fresh air entering the fireplace cavity 32 is more efficient for burning. The heat loss from the fireplace walls is reduced to a minimum with the provision of the heat shield 40 within the air spaces 25 and 28 as well as the positioning of the fresh air chamber 31 between the air space 28 and the outer rear panel 11. The heat in the fireplace is dissipated into the room in which the fireplace is located by the blower 43 which draws the cool room air through the bottom front grill 44 into the bottom air space 21, up the vertical rear air space 28 and the upper air space 25 to be heated by the fireplace, and the heated air is emitted out of the top front grill 45 into the room for heating purposes. In the above manner, the heat generated in the fireplace is efficiently released into the room. It can be appreciated that with the residual heat recovery provision of the coaxial venting system as well as the adjacent position of the fresh air chamber 31 and the vertical air space 28 the present fireplace has a high heating efficiency. Furthermore, the location of the fresh air chamber 31 at the rear also inherently keeps the rear panel 11 of the fireplace at a relatively cool temperature such that the fireplace can be installed with its rear panel 11 in close proximity with the building wall.

The canopies 41 and 42 slope downwardly in a cantilever manner towards the front of the fireplace cavity 32. The canopies 41 and 42 direct the fresh air towards the bottom of the fire log assembly 47 so that the fresh air is drawn upwards by the natural convection current rather than impinging directly upon the flame so that the flame may burn in a desirable gentle flickering manner.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A high efficiency direct top venting fireplace comprising, a firebox means having a top panel, two side panels, a rear panel, and a bottom panel, an outer top enclosure panel spaced from said top panel of said firebox means and forming a top air space located immediately adjacent to and above said top panel, an outer bottom enclosure panel sapced from said bottom panel of said firebox means and forming a bottom air space below said bottom panel, an inner enclosure panel spaced from said rear panel of said firebox means and forming a rear air space immediately adjacent to said rear panel; said top air space, bottom air space and rear air space being in communication with one another, and forming a hot air circulation chamber immediately adjacent to and surrounding said firebox means, an outer enclosure panel spaced from said inner enclosure panel and forming a fresh air chamber with said inner enclosure panel and located adjacent to said rear air space, said fresh air chamber being in communication with the cavity of said firebox means through at least one opening formed in a lower portion of said rear panel of said firebox means, a venting adaptor means disposed on said top panel of said outer top enclosure panel, said venting adaptor means having an outer chamber and an inner chamber disposed coaxially from one another, and said outer chamber being in communication with said fresh air chamber, and said inner chamber being in communication with said firebox means, said firebox means having a top venting duct extending vertically upwards through said venting adaptor means to couple with said inner chamber of said venting adaptor means, an L-sahped venting duct system means having an inner duct member and an outer duct member disposed in a spaced manner coaxially from one another, said venting duct system means having a vertical portion and an elongated horizontal portion substantially longer than said vertical portion, said inner duct member in said vertical portion of said venting duct system means being coupled to said inner chamber of said venting adaptor means and said outer duct member in said vertical portion of said venting duct system means being coupled to said outer chamber of said venting adaptor means, said outer duct member being operative to conduct fresh air from outdoor from a vent cap coupled to a free end of said horizontal portion of said venting duct system means and provided on a vertical outside wall of the building in which said fireplace is located, and said inner duct member being operative to conduct exhaust gases from said firebox means through (a substantially) said horizontal portion of said (inner duct member) venting duct system means to the outdoor through said vent cap.

2. A high efficiency direct top venting fireplace according to claim 1 including a forced air blower means located in said bottom air space and operative for causing an air current to flow through said bottom air space to said rear air space and said top air space.

3. A high efficiency direct top venting fireplace according to claim 2 including a heat shield means located within said top air space and rear air space and disposed in a spaced manner from said top panel and rear panel of said firebox means and from said inner enclosure panel and said outer top enclosure panel.

4. A high efficiency direct top venting fireplace according to claim 3 including an insulation chamber located between said outer top enclosure panel and said top panel of said firebox means, said insulation chamber being filled with heat insulation material.

* * * * *